US012404140B2

(12) United States Patent
Yamaguchi et al.

(10) Patent No.: US 12,404,140 B2
(45) Date of Patent: Sep. 2, 2025

(54) IMAGE RECORDING APPARATUS

(71) Applicant: BROTHER KOGYO KABUSHIKI KAISHA, Nagoya (JP)

(72) Inventors: Masatomo Yamaguchi, Inazawa (JP); Yuya Tatematsu, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 196 days.

(21) Appl. No.: 18/181,028

(22) Filed: Mar. 9, 2023

(65) Prior Publication Data

US 2023/0286771 A1 Sep. 14, 2023

(30) Foreign Application Priority Data

Mar. 11, 2022 (JP) ..... 2022-037976
Feb. 7, 2023 (JP) ..... 2023-016784

(51) Int. Cl.
*B65H 35/06* (2006.01)

(52) U.S. Cl.
CPC ..... *B65H 35/06* (2013.01); *B65H 2402/441* (2013.01); *B65H 2407/10* (2013.01); *B65H 2601/11* (2013.01)

(58) Field of Classification Search
CPC .. B65H 35/06; B65H 35/0066; B65H 35/002; B65H 2407/10; B65H 2402/441; B65H 2801/11; B65H 2801/12
USPC ..... 270/52.07
See application file for complete search history.

(56) References Cited

U.S. PATENT DOCUMENTS 9,238,566 B2 * 1/2016 Ogawa ..... B26D 7/2621
10,815,095 B2 * 10/2020 Honda ..... B41J 11/70
11,376,875 B2 * 7/2022 Kuronuma ..... B41J 11/663
12,157,300 B2 * 12/2024 Tsuji ..... B41J 29/13
12,194,737 B2 * 1/2025 Saito ..... B41J 11/005

FOREIGN PATENT DOCUMENTS

JP 2013-086235 A 5/2013

* cited by examiner

*Primary Examiner* — Leslie A Nicholson, III
(74) *Attorney, Agent, or Firm* — Merchant & Gould P.C.

(57) ABSTRACT

An image recording apparatus includes a conveyer configured to convey a sheet-like medium along a conveying path in a conveying direction, a recorder configured to record an image on the sheet-like medium conveyed by the conveyer, a cutter unit including one or more cutters and configured to cut the sheet-like medium in the conveying path, and a scanning mechanism configured to move at least one of the one or more cutters included in the cutter unit in a scanning direction parallel to the sheet-like medium lying along the conveying path and intersecting with the conveying direction. The scanning mechanism includes a support member extending in the scanning direction and configured to support the cutter unit. The conveyer includes a path member fixed to the support member and defining a portion of the conveying path upstream of the cutter unit in the conveying direction.

14 Claims, 6 Drawing Sheets

IMAGE RECORDING APPARATUS

REFERENCE TO RELATED APPLICATIONS

This application claims priority from Japanese Patent Application No. 2022-037976 filed on Mar. 11, 2022 and Japanese Patent Application No. 2023-016784 filed on Feb. 7, 2023. The entire contents of the priority applications are incorporated herein by reference.

BACKGROUND ART

Aspects of the present disclosure relate to an image recording apparatus including a cutter configured to cut a sheet-like medium.

There is known an image recording apparatus configured to record an image while conveying a long sheet-like medium such as sheet, cloth, or labels along a conveying path. Such image recording apparatus may include a cutter configured to cut the sheet-like medium. For example, there is known an image recording apparatus having a configuration in which a sheet cutting device including a cutter is disposed downstream of an image forming unit (recorder) in the conveying direction.

DESCRIPTION

If the sheet-like medium jams near the cutter, a user may injure his/her fingers with the cutter when dealing with jamming. Therefore, careful operation is required and time and effort to deal with the jam increases. Such a problem is not considered in conventional image recording apparatuses.

At least one aspect of the present disclosure is advantageous to provide an image recording apparatus that makes it possible to suppress time and effort to deal with the jam.

According to aspects of the present disclosure, there is provided an image recording apparatus including a conveyer configured to convey a sheet-like medium along a conveying path in a conveying direction, a recorder configured to record an image on the sheet-like medium conveyed by the conveyer, a cutter unit including one or more cutters and configured to cut the sheet-like medium in the conveying path, and a scanning mechanism configured to move at least one of the one or more cutters included in the cutter unit in a scanning direction parallel to the sheet-like medium lying along the conveying path and intersecting with the conveying direction. The scanning mechanism includes a support member extending in the scanning direction and configured to support the cutter unit. The conveyer includes a path member fixed to the support member and defining a portion of the conveying path upstream of the cutter unit in the conveying direction.

According to aspects of the present disclosure, there is further provided an image recording apparatus including a tray configured to accommodate a sheet-like medium, a conveyer configured to convey the sheet-like medium accommodated in the tray along a conveying path in a conveying direction, a recorder configured to record an image on the sheet-like medium conveyed by the conveyer, and a cutter unit including one or more cutters and configured to cut the sheet-like medium in the conveying path. The conveyer includes a feeder configured to feed the sheet-like medium accommodated in the tray in a feeding direction toward the conveying path, and a pair of path members opposing to each other across the conveying path. The pair of path members define a portion of the conveying path between the tray and the cutter unit and include a first path member disposed upstream of the portion of the conveying path between the tray and the cutter unit in the feeding direction, and a second path member disposed downstream of the portion of the conveying path between the tray and the cutter unit in the feeding direction. An angle on an acute side between the first path member and the portion of the conveying path between the tray and the cutter unit is larger than an angle on an acute side between the second path member and the portion of the conveying path between the tray and the cutter unit.

According to aspects of the present disclosure, there is further provided an image recording apparatus including a conveyer configured to convey a sheet-like medium along a conveying path in the conveying direction, a recorder configured to record an image on the sheet-like medium conveyed by the conveyer, a cutter unit including one or more cutters and configured to cut the sheet-like medium in the conveying path, a housing in which the conveying path is formed, an opening formed to the housing, and a cover configured to move relative to the housing between a closed position for closing the opening and an open position for opening the opening. The conveyer includes an intermediate roller disposed either upstream or downstream of the cutter unit in the conveying direction and including two rotating bodies and configured to move between a contact position where the two rotating bodies are in contact with each other and a separated position at which the two rotating bodies are spaced apart from each other. The opening exposes the intermediate roller to the outside of the housing. When the cover moves from the closed position to the open position, the intermediate roller moves from the contact position to the separated position.

OVERALL PRINTER CONFIGURATION

Figure 1:
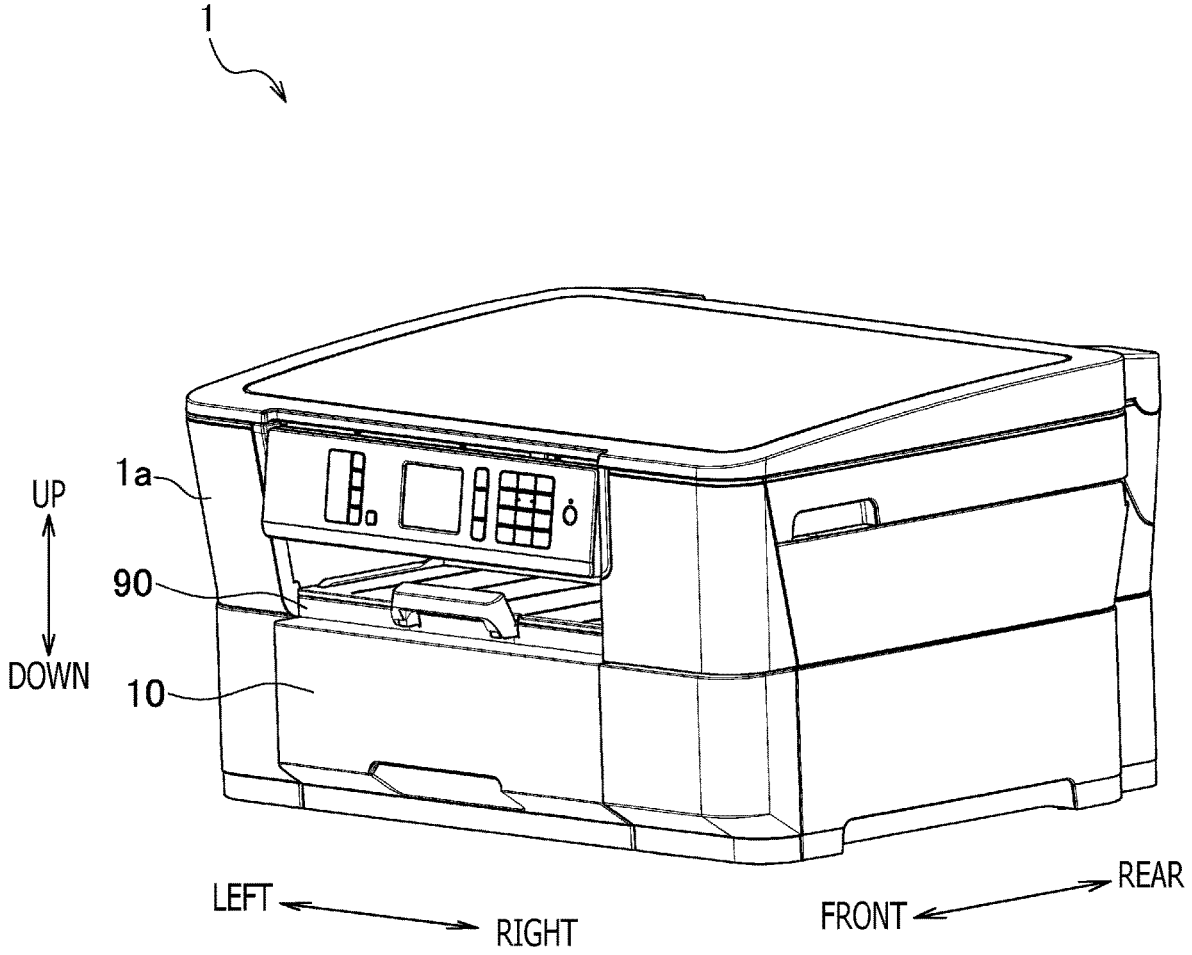
FIG. 1 is a perspective view of a printer.

As shown in FIG. 1, a printer 1 (image recording apparatus) according to an embodiment of the present disclosure includes a housing 1*a*, a sheet feed tray 10 removable from the housing 1*a*, and a sheet discharge tray 90.

Figure 2:
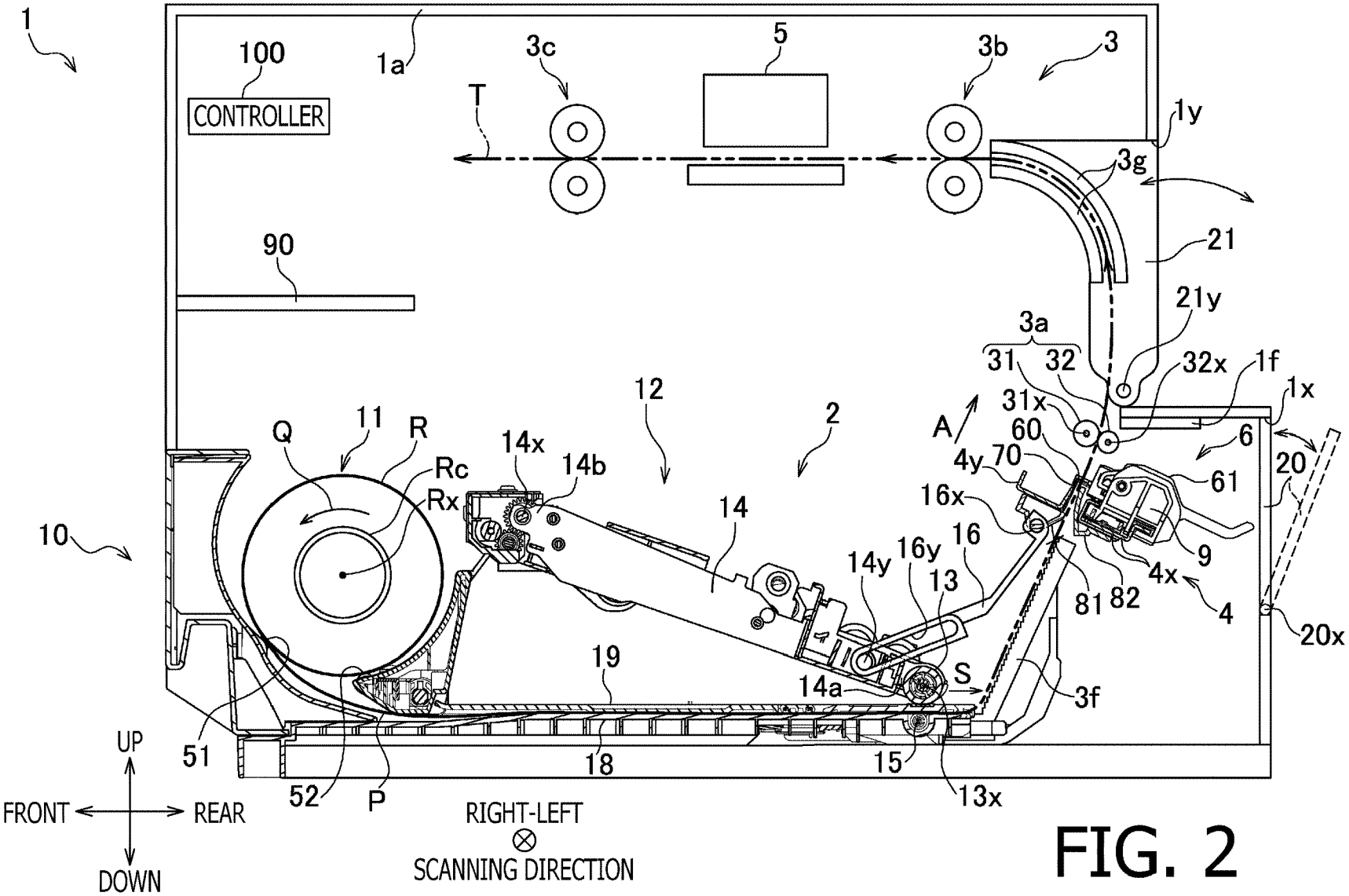
FIG. 2 is a schematic side view showing an internal structure of the printer.

As shown in FIG. 2, the printer 1 further includes a conveyer 3, a head 5, a cutter unit 6, a scanning mechanism 4, and a controller 100. Elements of the conveyer 3 other than rollers 51 and 52 described later, the head 5, the cutter unit 6, the scanning mechanism 4, and the controller 100 are supported by the housing 1*a*. The rollers 51 and 52 are supported by the sheet feed tray 10.

The conveyer 3 is configured to convey the sheet P along a conveying path T in a conveying direction. The conveyer 3 includes rollers 51 and 52, a roller 13, an arm 14, a guide member 16, a pair of path members 81 and 82, roller pairs 3*a*-3*c*, a separating member 3*f*, a pair of guide members 3*g*, and a conveying motor 3*x* (see FIG. 8) configured to drive the rollers.

The rollers 51 and 52, the roller 13, and the arm 14 of the conveyer 3 constitute a feeder 2 configured to feed the sheet P accommodated in the sheet feed tray 10 toward the conveying path T.

The conveying path T is a path that extends from the sheet feed tray 10 to the sheet discharge tray 90 while passing between the pair of guide members 3*g* and under the head 5. The conveying path T includes a U-shaped part at a portion upstream of the head 5 in the conveying direction. The separating member 3*f*, the cutter unit 6, the roller pair 3*a*, the scanning mechanism 4, and the pair of guide members 3*g* are disposed in the U-shaped part. The cutter unit 6, the scanning mechanism 4 and the roller pair 3*a* are disposed at a bottom portion of the U-shaped part. The cutter unit 6 and the scanning mechanism 4 are disposed downstream of the separating member 3*f* in the conveying direction and upstream of the roller pair 3*a* in the conveying direction.

The sheet feed tray 10 includes a roll sheet accommodating part 11 configured to accommodate a roll sheet R (see FIG. 2) and a cut sheet accommodating part 12 configured to accommodate a plurality of cut sheets Pc (see FIG. 3) stacked in an up-down direction. The cut sheet Pc accommodated in the cut sheet accommodating part 12 is supported by an upper surface of a support plate 19 disposed along a bottom plate 18 of the sheet feed tray 10.

Figure 3:
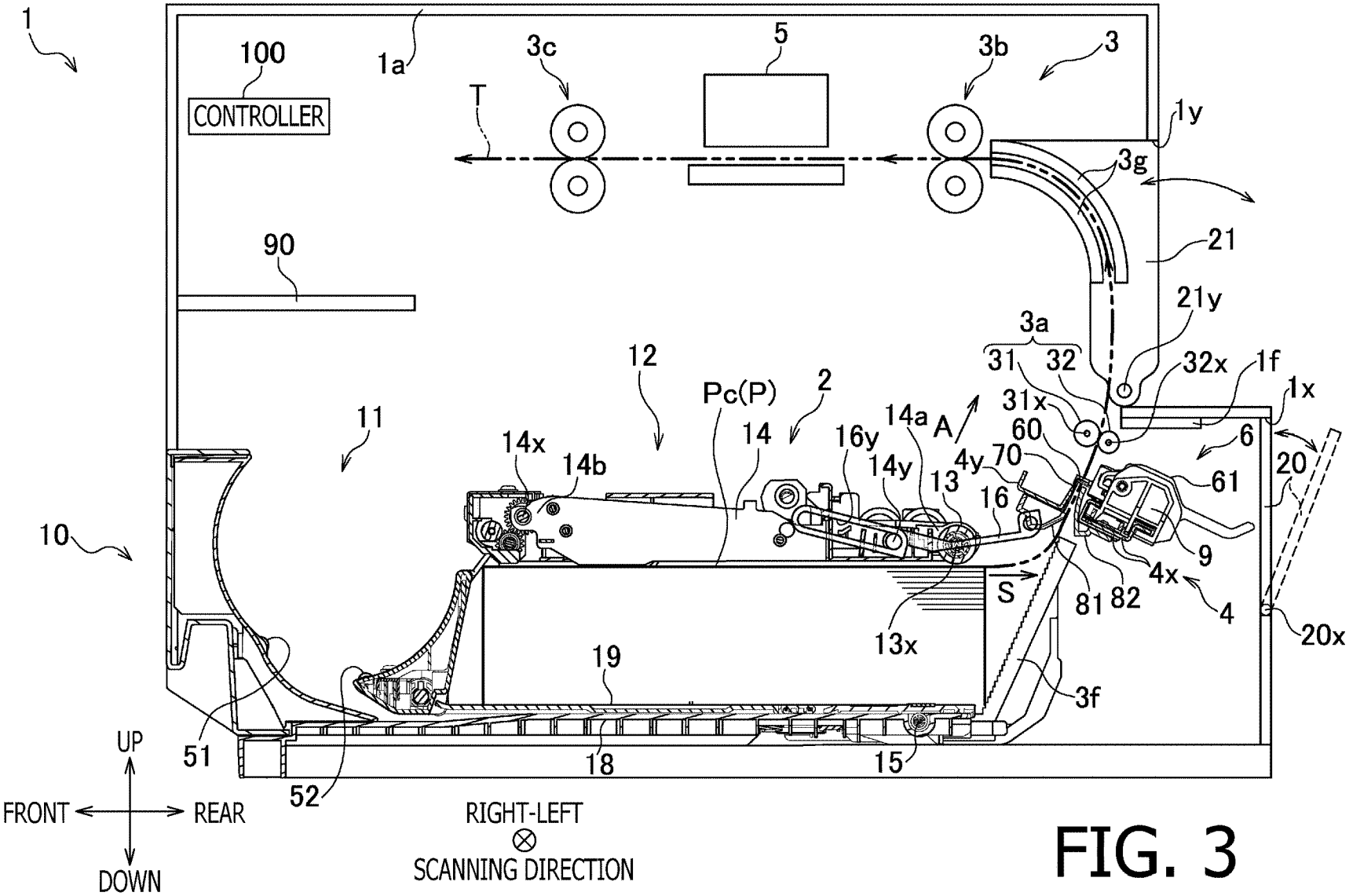
FIG. 3 is a schematic side view corresponding to FIG. 2 and showing a state in which cut sheets are accommodated in a sheet feed tray of the printer.

The cut sheets Pc are removed from the cut sheet accommodating part 12 when using the roll sheet R (see FIG. 2), and the roll sheet R is removed from the roll sheet accommodating part 11 when using the cut sheets Pc (see FIG. 3). The cut sheet accommodating part 12 is a space behind the roll sheet accommodating part 11.

In the present disclosure, the sheet P is used as a general term for sheet unwound from the roll sheet R and the cut sheet Pc. The cut sheet Pc is a sheet having a length along the conveying path T shorter than that of the sheet constituting the roll sheet R.

The roll sheet R is formed by winding a long sheet P in a roll shape on an outer peripheral surface of a cylindrical core member Rc. The roll sheet R is accommodated in the roll sheet accommodating part 11 with its rotation axis Rx (a center axis of the core member Rc) extending in the right-left direction.

The rollers 51 and 52 are disposed at the bottom of the roll sheet accommodating part 11. The rollers 51 and 52 are rotatable about respective axes extending in the right-left direction. When the roll sheet R is accommodated in the roll sheet accommodating part 11, an outer peripheral surface of a lower portion of the roll sheet R is supported by the rollers 51 and 52. When setting the roll sheet R, the roll sheet R is manually rotated in a direction indicated by an arrow Q in FIG. 2 to unwind the sheet P from the roll sheet R. Then, the sheet P is made to pass through a gap between a lower surface of the support plate 19 and an upper surface of the bottom plate 18, and a leading edge of the sheet P is nipped between the roller 13 and the roller 15. In this state, when the conveying motor 3*x* (see FIG. 4) is driven under the control of the controller 100 and the rollers 51, 52 and 13 rotate, the sheet P unwound from the roll sheet R is fed backward (in a feeding direction S).

The roller 13 is supported by one end 14*a* of the arm 14 and is rotatable about a shaft 13*x* extending in the right-left direction. The other end 14*b* of the arm 14 is supported by the housing 1*a* via a shaft 14*x* extending in the right-left direction. The arm 14 is swingable about the shaft 14*x* with the other end 14*b* as a fulcrum (see FIGS. 2 and 3).

In a state where the sheet feed tray 10 is mounted to the housing 1*a*, when no cut Pc sheet is accommodated in the cut sheet accommodating part 12, the roller 13 comes into contact with the upper surface of the support plate 19 (see FIG. 2). In a state where the sheet feed tray 10 is mounted to the housing 1*a*, when one or more cut sheets Pc are accommodated in the cut sheet accommodating part 12, the roller 13 comes into contact with the uppermost cut sheet Pc among the cut sheets Pc accommodated in the cut sheet accommodating part 12 (see FIG. 3). In this state, the cut sheet Pc is fed backward (i.e., in a feeding direction S) as the conveying motor 3*x* (see FIG. 4) is driven under the control of the controller 100 and the roller 13 rotates.

The sheet P fed from the sheet feed tray 10 by the roller 13 (i.e., the sheet P unwound from the roll sheet R accommodated in the roll sheet accommodating part 11 or the cut sheet Pc accommodated in the cut sheet accommodating part 12) comes into contact with the separating member 3*f*, moves along the separating member 3*f*, and is guided toward the roller pair 3*a*.

The separating member 3*f* is a member configuring a downstream end of the sheet feed tray 10 in the feeding direction S and defines a portion of the conveying path T.

The guide member 16 has a bent shape and has one end provided with a shaft 16*x* extending in the right-left direction and the other end provided with an elongated hole 16*y*. The shaft 16*x* is supported by the path member 81. A projection 14*y* formed near one end 14*a* of the arm 14 is inserted into the elongated hole 16*y*. As shown in FIGS. 2 and 3, the guide member 16 swings about the shaft 16*x* as the arm 14 swings and the projection 14*y* moves along the elongated hole 16*y*. The shaft 16*x* is provided between the sheet feed tray 10 and the cutter unit 6 in the conveying path T. The guide member 16 defines the conveying path T upstream of the pair of path members 81 and 82 in the conveying direction.

The separating member 3*f* is disposed behind the roller 13 and extends in an oblique direction intersecting with both the up-down direction and the front-rear direction. On a surface of the separating member 3*f*, fine irregularities repeating along the conveying path T are formed. The irregularities prevent double conveyance (i.e., a phenomenon in which a plurality of cut sheets Pc are conveyed in an overlapped state). In other words, the separating member 3*f* has a function of separating the cut sheet Pc in contact with the roller 13 from the other cut sheets Pc.

The head 5 includes a plurality of conventionally-known nozzles formed on a lower surface of the head 5, and a conventionally-known driver IC. When the sheet P conveyed by the conveyer 3 passes through a position facing the lower surface of the head 5, the driver IC is driven under the control of the controller 100, so that ink is ejected from the nozzles and lands on the sheet P, and an image is recorded on the sheet P. The head 5 may be of either a line type that ejects ink from the nozzles while the position is fixed or a serial type that ejects ink from the nozzles while moving in the right-left direction.

The cutter unit 6 is configured to cut the sheet P unwound from the roll sheet R between the separating member 3*f* and the roller pair 3*a* in the conveying path T. The cutter unit 6 includes cutter 60 and 70, and a holder 61 configured to hold the cutter 60. The holder 61 is detachably attached to the carriage 9.

The carriage 9 can be made to reciprocate in a scanning direction (right-left direction) by the scanning mechanism 4. The scanning direction is parallel to the sheet P lying along the conveying path T and intersects with a conveying direction A (See FIGS. 2 and 3. A conveying direction in the vicinity of the cutter unit 6).

Figure 4:
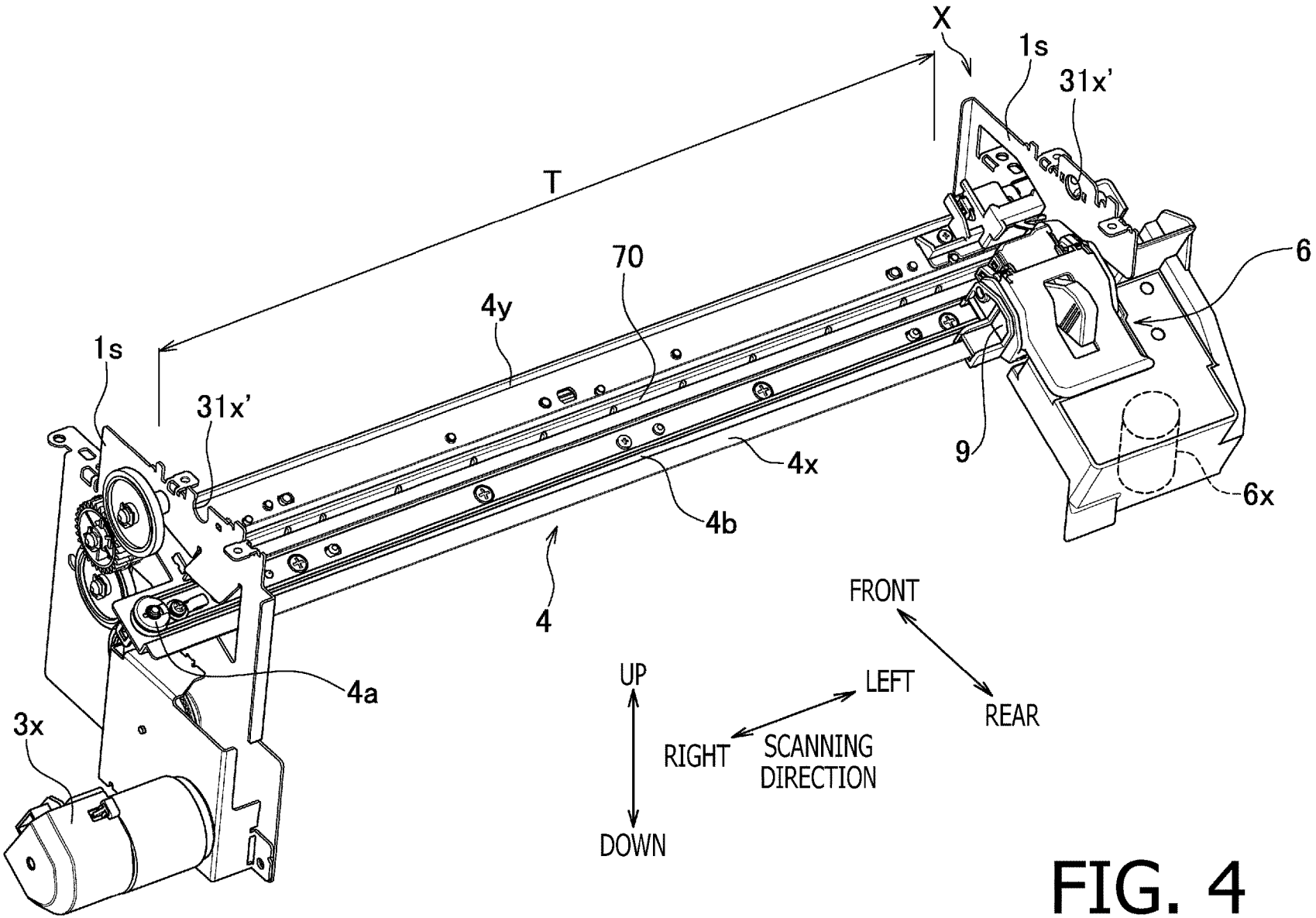
FIG. 4 is a perspective view of a cutter unit and a scanning mechanism included in the printer.

As shown in FIG. 4, the scanning mechanism 4 includes a pair of guide rails 4*x* and 4*y* extending in the scanning direction, a pair of pulleys 4*a* (only one of which is shown in FIG. 4) disposed to be spaced apart from each other in the scanning direction, a belt 4*b* wound around the pair of pulleys 4*a* and having the carriage 9 fixed thereto, and a cutting motor 6*x*. The guide rail 4*y* is located in front of the guide rail 4*x* and is spaced apart from the guide rail 4*x* with a small gap. The conveying path T (see FIGS. 2 and 3) is formed in this gap.

As shown in FIG. 4, the guide rails 4*x* and 4*y* are fixed to a pair of side frames 1*s* with screws or the like. The pair of side frames 1*s* are portions of the housing 1*a* and are made of metal or the like. The pair of side frames 1*s* are spaced apart from each other in the right-left direction and support the left and right ends of the guide rails 4*x* and 4*y*.

The pair of pulleys 4*a*, the belt 4*b*, and the cutting motor 6*x* are attached to the guide rail 4*x*. The guide rail 4*x* supports the carriage 9 fixed to the belt 4*b*, and the holder 61 and the cutter 60 mounted to the carriage 9.

Figure 5:
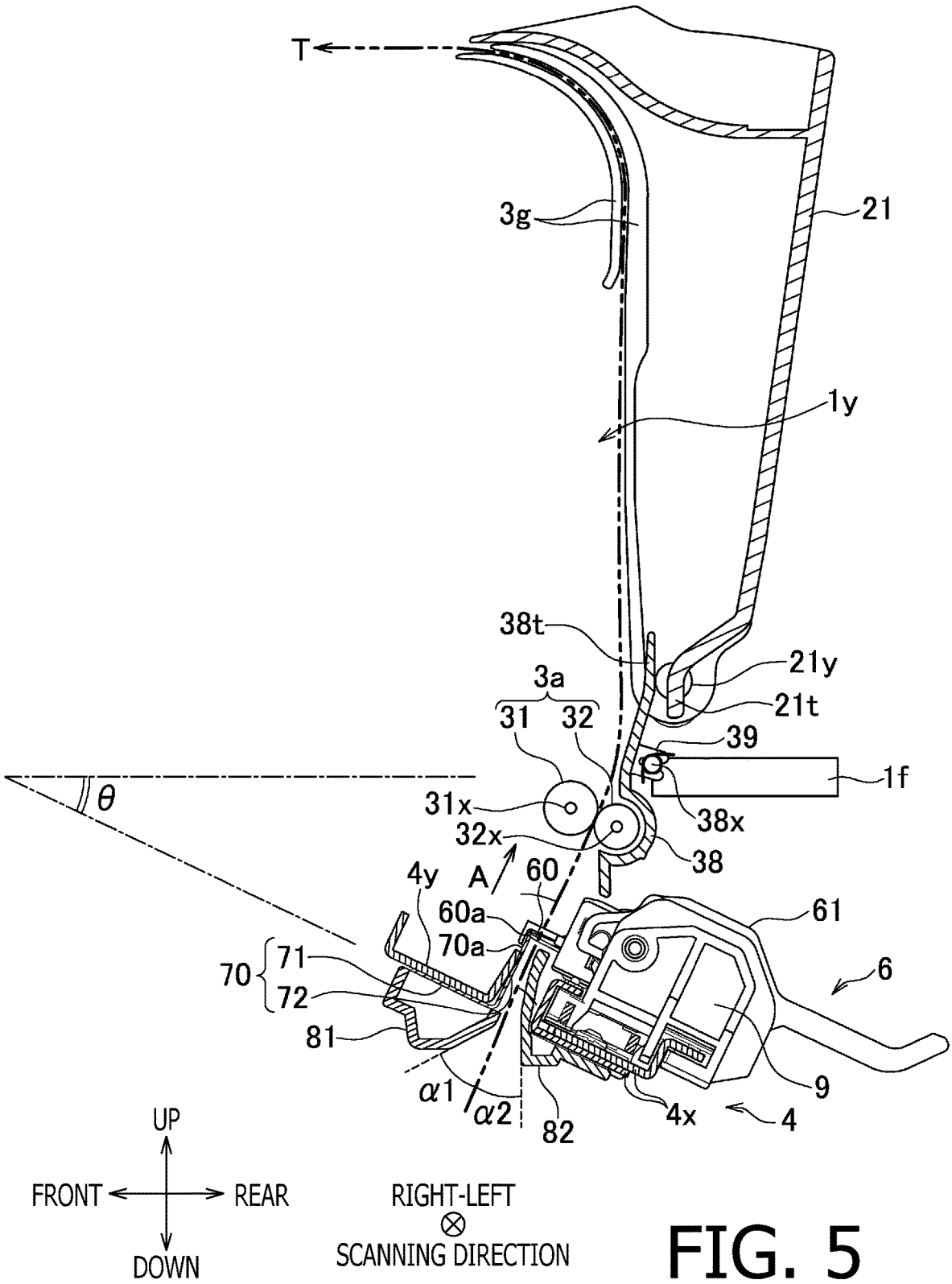
FIG. 5 is a side cross-sectional view showing a state in which a cover is at a closed position and a roller pair is at a contact position.

The guide rail 4*y* supports the cutter 70. As shown in FIG. 5, the cutter 70 is L-shaped and has a portion 71 that covers a lower surface of the guide rail 4*y* and a portion 72 that covers a side surface of the guide rail 4*y* that defines the conveying path T. The portion 72 of the cutter 70 extends along the conveying path T. The cutter 70 has a blade 70*a* at an end portion of the portion 72 on the downstream side in the conveying direction A.

While the cutter 70 is fixed, the cutter 60 rotates. The cutter 60 is disk-shaped and has a blade 60*a* at its peripheral edge. When cutting the sheet P, the blade 60*a* of the cutter 60 extends in a direction intersecting with the sheet P lying along the conveying path T downstream of the blade 70*a* of the cutter 70 in the conveying direction A, and overlaps with the blade 70*a* of the cutter 70 in the conveying direction A.

When the cutting motor 6*x* is driven under the control of the controller 100, the belt 4*b* travels in the scanning direction, and the carriage 9 and the holder 61 move from an attaching/detaching position X outside the conveying path T into the conveying path T. At this time, the cutter 60 rotates by the driving of the cutting motor 6*x*. The sheet P unwound from the roll sheet R is cut in a width direction of the sheet P by the fixed cutter 70 and the cutter 60 rotating while moving in the scanning direction.

The attaching/detaching position X is at left ends of the guide rails 4*x* and 4*y*, which is a home position of the movement of the carriage 9 as described above, and is also a position for attaching/detaching the holder 61 to/from the carriage 9.

As shown in FIGS. 2 and 3, the pair of path members 81 and 82 are disposed so as to oppose each other across the conveying path T, and define a portion of the conveying path T upstream of the cutter unit 6 in the conveying direction (i.e., a portion between the sheet feed tray 10 and the cutter unit 6). The path member 81 is located in front of, upstream in the feeding direction S (see FIG. 3) of, and downstream in a winding direction of the sheet P constituting the roll sheet R (a direction shown by an arrow Q shown in FIG. 2) of, a portion of the conveying path T defined by the pair of path members 81 and 82 (i.e., a portion between the pair of path members 81 and 82). The path member 82 is located behind, and downstream in the feeding direction S (see FIG. 3) of, the portion of the conveying path T defined by the pair of path members 81 and 82.

The path member 81 is fixed to the guide rail 4*y*, and the path member 82 is fixed to the guide rail 4*x*.

Furthermore, as shown in FIG. 5, an angle $\alpha$1 (an angle on the acute side) between the path member 81 and the portion of the conveying path T defined by the pair of path members 81 and 82 (i.e., a portion between the pair of path members 81 and 82) is larger than an angle $\alpha$2 (an angle on the acute side) between the path member 82 and the portion of the conveying path T defined by the pair of path members 81 and 82.

As shown in FIG. 5, the portion of the conveying path T defined by the pair of path members 81 and 82 is orthogonal to the cutter 60. Furthermore, as shown in FIGS. 2 and 3, the portion of the conveying path T defined by the pair of path members 81 and 82 is extending along the conveying direction A, is parallel to a portion of the conveying path T defined by the separating member 3*f*, and is parallel to a portion of the conveying path T defined by later-described two rotating bodies 31 and 32. The angles $\alpha$1 and $\alpha$2 are angles between the surfaces of the path members 81 and 82 facing the conveying path T and the portion of the conveying path T defined by the pair of path members 81 and 82.

In view of preventing jamming, the path members 81 and 82 are designed such that an angle on the acute side between the surface of the path member 81 facing the conveying path T and a leading edge of the sheet P unwound from the roll sheet R and abutting the path member 81 (a first entry angle) and an angle on the acute side between the surface of the path member 82 facing the conveying path T and a leading edge of the cut sheet Pc abutting the path member 82 (a second entry angle) become equal to or less than a prescribed angle (e.g., 63 degrees). In the present embodiment, the first entry angle is about 50 degrees, and the second entry angle is about 55 to 58 degrees. That is, the first entry angle is smaller than the second entry angle.

As shown in FIGS. 2 and 3, the roller pair 3*a* is disposed downstream of the cutter unit 6 in the conveying direction, and includes two rotating bodies 31 and 32. The two rotating bodies 31 and 32 are rotatable about rotation shafts 31*x* and 32*x* extending in the right-left direction, respectively.

The rotation shaft 31*x* of the rotating body 31 disposed in front of the rotating body 32 is supported by a pair of side frames 1*s* (see FIG. 4). As shown in FIG. 4, the right and left ends of the rotation shaft 31*x* are inserted into holes 31*x*' formed to the pair of side frames 1*s*.

Figure 6:
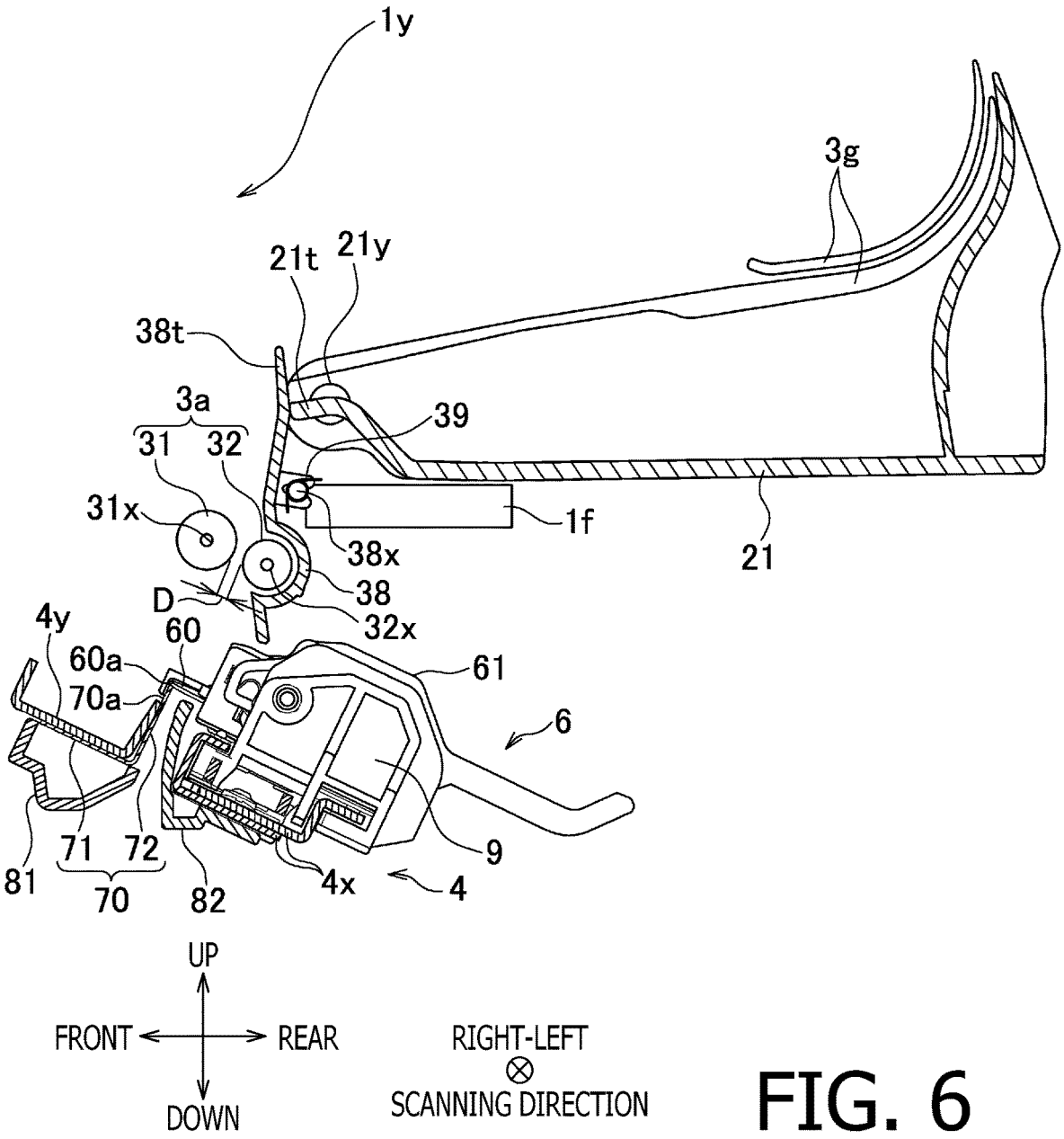
FIG. 6 is a side cross-sectional view showing a state in which the cover is at an open position and the roller pair is at a separated position.

As shown in FIGS. 5 and 6, the rotating body 32 disposed behind the rotating body 31 is rotatably supported by a holder 38. The holder 38 is swingable about a swing axis 38*x* in the right-left direction. As the holder 38 swings, the rotating body 32 supported by the holder 38 swings. Thus, the roller pair 3*a* can move between a contact position where the two rotating bodies 31 and 32 are in contact with each other (see FIG. 5) and a separated position where the two rotating bodies 31 and 32 are spaced apart from each other (see FIG. 6). A distance D between the two rotating bodies 31 and 32 when the roller pair 3*a* is at the separated position is such that a human finger does not enter (e.g., 5 mm or less).

A torque spring 39 is attached to a shaft 38*x* of the holder 38. The torque spring 39 urges the holder 38 in a direction in which the holder 38 swings clockwise in FIGS. 5 and 6 about the shaft 38*x* (i.e., in a direction in which the roller pair 3*a* moves from the separated position to the contact position).

The shaft 38*x* of the holder 38 is located downstream of a rotation shaft 32*x* of the rotating body 32 in the conveying direction A, and is supported by a frame 1*f*.

The frame 1*f* is a part of the housing 1*a* and is made of metal or the like. The frame 1*f* extends in a horizontal direction (i.e., a direction orthogonal to the up-down direction). In contrast, the guide rails 4$x$ and 4$y$ extend in an oblique direction intersecting with both the up-down direction and the front-rear direction, and are inclined downward toward the rear. Thus, an angle θ between the frame 1$f$ and the guide rails 4$x$ and 4$y$ is an acute angle (see FIG. 5).

As shown in FIGS. 2 and 3, two openings 1$x$ and 1$y$ arranged in the up-down direction are formed to a rear wall of the housing 1$a$. Through the lower opening 1$x$, a portion inside the housing 1$a$ including the attaching/detaching position X (i.e., the carriage 9 at the attaching/detaching position X: see FIG. 4) is exposed to the outside of the housing 1$a$. Through the upper opening 1$y$, the roller pair 3$a$ is exposed to the outside of the housing 1$a$. The openings 1$x$ and 1$y$ are formed at portions of the housing 1$a$ that face the bottom portion of the U-shaped part of the conveying path T.

As shown in FIGS. 2 and 3, a cover 20 configured to cover the opening 1$x$ and a cover 21 configured to cover the opening 1$y$ are attached to the rear wall of the housing 1$a$ movably relative to the housing 1$a$.

The cover 20 is swingable about a shaft 20$x$ provided at a lower end of the opening 1$x$ and extending along the right-left direction, and can move between a closed position for closing the opening 1$x$ (see the solid line in FIG. 2) and an open position for opening the opening 1$x$ (see the broken line in FIG. 2) by swinging about the shaft 20$x$. By placing the cover 20 at the open position (see the broken line in FIG. 2), a space between the frame 1$f$ and the guide rails 4$x$ and 4$y$ can be accessed through the opening 1$x$. Therefore, it becomes possible to attach and detach the holder 61 to and from the carriage 9 at the attaching/detaching position X, and it becomes possible to deal with jamming.

The cover 21 is swingable about a shaft 21$y$ provided at a lower end of the opening 1$y$ and extending along the right-left direction, and can move between a closed position for closing the opening 1$y$ (see FIG. 5) and an open position for opening the opening 1$y$ (see FIG. 6) by swinging about the shaft 21$y$.

When the cover 21 is at the closed position (see FIG. 5), an upper end 38$t$ of the holder 38 and a lower end 21$t$ of the cover 21 overlap with each other in the front-rear direction and are spaced apart from each other in the front-rear direction with a slight gap therebetween. When the cover 21 moves from the closed position (see FIG. 5) to the open position (see FIG. 6), the lower end 21$t$ of the cover 21 comes into contact with the upper end 38$t$ of the holder 38 to move the upper end 38$t$ forward against the urging force of the torque spring 39. At this time, the roller pair 3$a$ moves from the contact position (see FIG. 5) to the separated position (see FIG. 6) as the holder 38 swings about the shaft 38$x$ and the rotating body 32 held by the holder 38 moves backward.

When the cover 21 moves from the open position (see FIG. 6) to the closed position (see FIG. 5), the lower end 21$t$ of the cover 21 is separated from the upper end 38$t$ of the holder 38, and the holder 38 swings clockwise in FIGS. 5 and 6 about the shaft 38$x$ by the urging force of the torque spring 39. As a result, the roller pair 3$a$ moves from the separated position (see FIG. 6) to the contact position (see FIG. 5).

As described above, the roller pair 3$a$ moves between the contact position and the separated position in conjunction with the opening/closing motion of the cover 21.

The cover 21 is provided with a pair of guide members 3$g$. When the cover 21 is at the closed position (see FIG. 5), the cover 21 forms the conveying path T. By placing the cover 21 at the open position (see FIG. 6) and placing the roller pair 3$a$ at the separated position, the sheet P jammed around the cutters 60 and 70 can be taken out of the housing 1$a$ through the opening 1$y$ through the gap between the two rotating bodies 31 and 32 with the distance D and between the pair of guide members 3$g$.

As described above, according to the present embodiment, the path members 81 and 82 are fixed to the guide rails 4$x$ and 4$y$ to position the path members 81 and 82 with respect to the guide rails 4$x$ and 4$y$ (see FIGS. 2 and 3). Therefore, the sheet P can be smoothly conveyed from the path members 81 and 82 toward the cutter unit 6 supported by the guide rails 4$x$ and 4$y$, and thus jamming is less likely to occur. Accordingly, it is possible to reduce the time and effort to deal with the jam.

According to the present embodiment, the angle α1 between the path member 81 and the portion of the conveying path T defined by the pair of path members 81 and 82 is larger than the angle α2 between the path member 82 and the portion of the conveying path T defined by the pair of path members 81 and 82 (see FIG. 5). For example, when conveying the sheet P unwound from the roll sheet R with the conveyer 3 (see FIG. 2), the leading edge of the sheet P is likely to contact the path member 81. In this case, since the angle α1 is large, a path width of an entry portion between the pair of path members 81 and 82 is large, and thus it is easier to guide the leading edge of the sheet P to between the pair of path members 81 and 82. Therefore, the sheet P can be appropriately guided and thus jamming is less likely to occur. Accordingly, it is possible to suppress the time and effort to deal with the jam. Furthermore, for example, when feeding an uppermost cut sheet Pc among the cut sheets Pc accommodated in the cut sheet accommodating part 12 with the feeder 2 (see FIG. 3), if the angle α1 is small, a leading edge of the fed uppermost cut sheet Pc may come into contact with the path member 81 and jamming may occur. In this respect, according to the present embodiment, since the angle α1 is large, the contact of the leading edge of the uppermost cut sheet Pc with the path member 81 can be suppressed and thus jamming is less likely to occur. Accordingly, it is possible to suppress the time and effort to deal with the jam.

According to the present embodiment, when the cover 21 is moved from the closed position (see FIG. 5) to the open position (see FIG. 6), the roller pair 3$a$ moves from the contact position (see FIG. 5) to the separated position (see FIG. 6), and the sheet P jammed around the cutters 60 and 70 can be taken out of the housing 1$a$ through the gap between the two rotating bodies 31 and 32 with the distance D. When the cover 21 is moved from the open position (see FIG. 6) to the closed position (see FIG. 5) after dealing with jamming, the roller pair 3$a$ moves from the separated position (see FIG. 6) to the contact position (see FIG. 5), and the recording process can be executed. By linking the position of the roller pair 3$a$ with the opening and closing operation of the cover 21, it is possible to suppress the time and effort to deal with the jam.

The path member 81 is located downstream of a portion of the conveying path T defined by the pair of path members 81 and 82 (i.e., the portion between the pair of path members 81 and 82) in the winding direction of the sheet P constituting the roll sheet R (the direction indicated by the arrow Q shown in FIG. 2). Due to this configuration, a leading edge of the sheet P unwound from the roll sheet R easily comes into contact with the path member 81, and thus the sheet P can be appropriately guided by the path member 81. Therefore, the sheet P can be smoothly conveyed from the path member 81 toward the cutter unit 6, and thus jamming is less likely to occur.

The path member 82 is located downstream of the portion of the conveying path T defined by the pair of path members 81 and 82 (i.e., the portion between the pair of path members 81 and 82) in the feeding direction S (see FIG. 3). Due to this configuration, the leading edge of the cut sheet Pc fed from the cut sheet accommodating part 12 can easily come into contact with the path member 82, and thus the cut sheet Pc can be appropriately guided by the path member 82. Therefore, the sheet P can be smoothly conveyed from the path member 82 toward the cutter unit 6, and thus jamming is less likely to occur.

The printer 1 includes the pair of path members 81 and 82 opposing to each other across the conveying path T. Due to this configuration, the sheet P can be smoothly conveyed toward the cutter unit 6 by the pair of path members 81 and 82, and thus jamming is less likely to occur.

The shaft 16*x* of the guide member 16 is fixed to the path member 81, so that the guide member 16 is positioned with respect to the path member 81 (see FIGS. 2 and 3). Due to this configuration, the sheet P can be smoothly conveyed from the guide member 16 toward the path member 81, and thus jamming is less likely to occur.

The guide rails 4*x* and 4*y* and the rotation shaft 31*x* of the rotating body 31 are fixed to the same member (i.e., the side frame 1*s* shown in FIG. 3), and thus the guide rails 4*x* and 4*y* are positioned with respect to the rotating body 31. Due to this configuration, the conveyance of the sheet P between the cutter unit 6 supported by the guide rails 4*x* and 4*y* and the roller pair 3*a* becomes smooth, and thus jamming is less likely to occur.

The distance D (see FIG. 6) between the two rotating bodies 31 and 32 when the roller pair 3*a* is at the separated position is such that a human finger does not enter. Due to this configuration, when taking the sheet P jammed around the cutters 60 and 70 out of the housing 1*a* through the opening 1*y*, the user's fingers will not reach the cutters 60 and 70 through the gap between the two rotating bodies 31 and 32. Therefore, it is possible to prevent the user from injuring his or her finger with the cutters 60 and 70.

The roller pair 3*a* is disposed downstream of the cutter unit 6 in the conveying direction (see FIGS. 2 and 3). Due to this configuration, when the sheet P is jammed around the cutters 60 and 70, the cutter unit 6 can cut the sheet P, and a portion of the sheet P downstream of a cutting position by the cutter unit 6 in the conveying direction can be taken out of the housing 1*a* through the gap between the two rotating bodies 31 and 32.

The printer 1 includes the holder 38 configured to rotatably support one (the rotating body 32) of the two rotating bodies 31 and 32 constituting the roller pair 3*a*, and the roller pair 3*a* moves from the contact position (see FIG. 5) to the separated position (see FIG. 6) as the holder 38 comes into contact with the cover 21 and swings. Therefore, the position of the roller pair 3*a* is more effectively linked with the opening and closing operation of the cover 21.

The shaft 38*x* of the holder 38 is located downstream of the rotation shaft 32*x* of the rotating body 32 in the conveying direction A (see FIGS. 5 and 6). Due to this configuration, compared to a case where the shaft 38*x* of the holder 38 is located upstream of the rotation shaft 32*x* of the rotating body 32 in the conveying direction A, a space downstream of the cutter unit 6 in the conveying direction A can be secured, and thus it is easier to deal with jamming.

The frame 1*f* and the guide rails 4*x* and 4*y* are arranged to form the acute angle θ (see FIG. 5), Due to this configuration, it is easy to access a space between the frame 1*f* and the guide rails 4*x* and 4*y* to deal with jamming.

Modification

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below:

In the above-described embodiment, the portion of the conveying path T defined by the pair of path members 81 and 82 is orthogonal to the cutter 60, is parallel to a portion of the conveying path T defined by the separating member 3*f*, and is parallel to a portion of the conveying path T defined by the two rotating bodies 31 and 32. However, the portion of the conveying path T defined by the pair of path members 81 and 82 is not limited to the one that satisfies all of these conditions but may be the one that satisfies at least one of these conditions.

In the above-described embodiment, the cutter unit 6 includes the disk-shaped rotating cutter 60 and the fixed cutter 70. However, the cutter unit 6 may include a pair of disk-shaped rotating cutters. Furthermore, the number of cutters included in the cutter unit 6 is not limited to two, but may be one or three or more.

In the above-described embodiment, the scanning mechanism 4 moves one of the cutters (i.e., the cutter 60) included in the cutter unit. However, for example, the scanning mechanism 4 may move all the cutters included in the cutter unit (e.g., a pair of disk-shaped cutters configured to rotate).

In the above-described embodiment, the path members 81 and 82 are formed as a pair. However, for example, only one of the path members 81 and 82 may be provided.

In the above-described embodiment, the roller pair 3*a* is disposed downstream of the cutter unit in the conveying direction. However, the roller pair 3*a* may be disposed upstream of the cutter unit in the conveying direction.

The sheet P is not limited to paper, but may be cloth or plastic film. In other words, the sheet P may be made of any material as long as it is sheet-like.

The head 5 may discharge liquid other than ink (e.g., a treatment liquid for aggregating or precipitating components in the ink). The head 5 is not limited to a liquid discharge system, and may be a laser system, a thermal transfer system, or the like.

Aspects of the present disclosure may be applied not only to a printer but can also to a facsimile machine, a copy machine, a multi-function machine, and the like.

The sheet feed tray 10 is an example of a "tray" according to aspects of the present disclosure. The sheet P is an example of a "sheet-like medium" according to aspects of the present disclosure. The separating member 3*f* is an example of a "wall" according to aspects of the present disclosure. The shaft 16*x* is an example of a "first shaft" according to aspects of the present disclosure. The head 5 is an example of a "recorder" according to aspects of the present disclosure. The pair of guide rails 4$x$ and 4$y$ are examples of a "supporting member" according to aspects of the present disclosure. The path member 81 is an example of a "first path member" according to aspects of the present disclosure. The path member 82 is an example of a "second path member" according to aspects of the present disclosure. The roller pair 3$a$ is an example of an "intermediate roller" according to aspects of the present disclosure. The shaft 38$x$ is an example of a "second shaft" according to aspects of the present disclosure. The opening 1$y$ is an example of an "opening" according to aspects of the present disclosure.

What is claimed is:

1. An image recording apparatus comprising:

a conveyer configured to convey a sheet-like medium along a conveying path in a conveying direction;

a recorder configured to record an image on the sheet-like medium conveyed by the conveyer;

a cutter unit including one or more cutters and configured to cut the sheet-like medium in the conveying path; and a scanning mechanism configured to move at least one of the one or more cutters included in the cutter unit in a scanning direction parallel to the sheet-like medium lying along the conveying path and intersecting with the conveying direction, wherein the scanning mechanism includes a support member extending in the scanning direction and configured to support the cutter unit, and wherein the conveyer includes a path member extending from and fixed to the support member and defining a portion of the conveying path upstream of the cutter unit in the conveying direction.

2. The image recording apparatus according to claim 1, comprising a tray configured to accommodate a roll body formed by winding the sheet-like medium in a roll shape, wherein the conveyer conveys the sheet-like medium unwound from the roll body accommodated in the tray along the conveying path, and wherein the path member is located downstream of the portion of the conveying path defined by the path member in a winding direction of the sheet-like medium constituting the roll body.

3. The image recording apparatus according to claim 1, comprising a tray configured to accommodate a plurality of sheet-like medium in a stacked state, wherein the conveyer includes a feeder configured to feed an uppermost sheet-like medium among the plurality of sheet-like medium accommodated in the tray in a feeding direction toward the conveying path, and wherein the path member is located downstream of the portion of the conveying path defined by the path member in the feeding direction.

4. The image recording apparatus according to claim 1, comprising a pair of the path members opposing to each other across the conveying path.

5. The image recording apparatus according to claim 1, comprising a tray configured to accommodate a plurality of sheet-like medium in a stacked state, wherein the conveyer includes:

a roller configured to come into contact with an uppermost sheet-like medium among the plurality of sheet-like medium accommodated in the tray and configured to feed the sheet-like medium;

an arm having one end configured to support the roller and the other end and configured to swing about the other end as a fulcrum; and a guide member configured to move in conjunction with the swinging of the arm, the guide member being configured to swing about a first shaft provided between the tray and the cutter unit in the conveying path and configured to define a portion of the conveying path upstream of the path member in the conveying direction, wherein the first shaft is supported by the path member.

6. The image recording apparatus according to claim 1, wherein the conveyer includes an intermediate roller disposed either upstream or downstream of the cutter unit in the conveying direction and configured to rotate about a rotation shaft, and wherein the image recording apparatus further includes a member that supports both the support member and the rotation shaft.

7. An image recording apparatus comprising:

a tray configured to accommodate a sheet-like medium;

a conveyer configured to convey the sheet-like medium accommodated in the tray along a conveying path in a conveying direction;

a recorder configured to record an image on the sheet-like medium conveyed by the conveyer; and a cutter unit including one or more cutters and configured to cut the sheet-like medium in the conveying path, wherein the conveyer includes:

a feeder configured to feed the sheet-like medium accommodated in the tray in a feeding direction toward the conveying path; and a pair of path members opposing to each other across the conveying path, wherein the pair of path members define a portion of the conveying path between the tray and the cutter unit and include a first path member disposed upstream of the portion of the conveying path between the tray and the cutter unit in the feeding direction, and a second path member disposed downstream of the portion of the conveying path between the tray and the cutter unit in the feeding direction, wherein an angle on an acute side between the first path member and the portion of the conveying path between the tray and the cutter unit is larger than an angle on an acute side between the second path member and the portion of the conveying path between the tray and the cutter unit.

8. The image recording apparatus according to claim 7, wherein the tray is configured to accommodate a roll body formed by winding the sheet-like medium in a roll shape, wherein the conveyer conveys the sheet-like medium unwound from the roll body accommodated in the tray along the conveying path, and wherein the first path member is located downstream of the portion of the conveying path between the tray and the cutter unit in a winding direction of the sheet-like medium constituting the roll body.

9. The image recording apparatus according to claim 7, wherein the tray is configured to accommodate a plurality of sheet-like medium in a stacked state, wherein the feeder is configured to feed an uppermost sheet-like medium among the plurality of sheet-like medium accommodated in the tray.

10. The image recording apparatus according to claim 7, wherein the portion of the conveying path between the tray and the cutter unit is orthogonal to at least one of the one or more cutters.

11. The image recording apparatus according to claim 7, wherein the conveyer includes a wall configuring a downstream end of the tray in the feeding direction and defining a portion of the conveying path, and wherein the portion of the conveying path between the tray and the cutter unit is parallel to the portion of the conveying path defined by the wall.

12. The image recording apparatus according to claim 7, wherein the conveyer includes an intermediate roller disposed downstream of the cutter unit in the conveying direction and including two rotating bodies, and wherein the portion of the conveying path between the tray and the cutter unit is parallel to a portion of the conveying path defined by the two rotating bodies.

13. The image recording apparatus according to claim 1, wherein the path member is disposed upstream of the recorder in the conveying direction.

14. The image recording apparatus according to claim 13, wherein the cutter unit is disposed upstream of the recorder in the conveying direction.

* * * * *